United States Patent [19]

Massbaum

[11] Patent Number: 4,676,760

[45] Date of Patent: Jun. 30, 1987

[54] INFLATABLE FLOTATION DEVICE

[75] Inventor: Ross Massbaum, East Moriches, N.Y.

[73] Assignee: Sea Hands Enterprises, Inc., N.Y.

[21] Appl. No.: 794,733

[22] Filed: Nov. 4, 1985

[51] Int. Cl.[4] ..... A63B 31/10

[52] U.S. Cl. ..... 441/56; 441/57; 441/88

[58] Field of Search ..... 441/55–58, 441/88, 122

[56] References Cited

U.S. PATENT DOCUMENTS

| | | | |
|---|---|---|---|
| 216,455 | 6/1879 | Primbs | 441/58 |
| 789,428 | 5/1905 | Hruby et al. . | |
| 1,457,858 | 6/1923 | Ruddell | 441/57 |
| 1,611,427 | 12/1926 | Evans | 441/122 |
| 1,684,714 | 9/1928 | Perry . | |
| 2,536,390 | 1/1951 | Pobochenko . | |
| 3,122,760 | 3/1964 | Glass | 441/57 |
| 3,174,167 | 3/1965 | Pauley | 441/57 |
| 3,286,287 | 11/1966 | Martin | 441/57 |
| 3,802,009 | 4/1974 | Clemente . | |
| 3,874,014 | 4/1975 | Davey . | |
| 4,121,312 | 10/1978 | Penney . | |

FOREIGN PATENT DOCUMENTS

| | | | |
|---|---|---|---|
| 2525932 | 12/1976 | Fed. Rep. of Germany | 441/58 |
| 13465 | of 1889 | United Kingdom | 441/56 |

*Primary Examiner*—Joseph F. Peters, Jr.
*Assistant Examiner*—Stephen P. Avila
*Attorney, Agent, or Firm*—Lewis H. Eslinger

[57] ABSTRACT

An inflatable flotation device is formed of two adjustably inflatable chambers superimposed one upon another and joined by an airtight seam substantially circumscribing the periphery of the chambers and conforming generally to the outline of a user's hand and lower forearm, and a hollow portion arranged between adjacent sides of the inflatable chambers defines a space for receiving such user's hand and lower forearm. The two chambers are in mutual fluid communication and controlling the extent of inflation of the device controls the tightness of fit about the user's hand and lower forearm. A sealed area in one of the two chambers is corresponds generally to the location of the user's palm to facilitate bending of the device in the inflated mode.

17 Claims, 9 Drawing Figures

INFLATABLE FLOTATION DEVICE

BACKGROUND OF THE INVENTION

1. Field of the Invention

The present invention relates generally to flotation devices and, more particularly, to adjustably inflatable swimming devices for fitting over each of a user's hands and lower forearms to facilitate swimming or for physical conditioning or therapeutic use, and also to provide life-saving functions.

2. Description of the Prior Art

The use of air-filled bladders and the like to assist a person in floating or swimming has been known for many years. Inner tubes and inflatable rings are familiar objects at many beaches. There are also well-known devices to aid a person in propelling himself through water, in the form of fins with increased surface area over that provided by the hands and feet of the swimmer.

A specialized form of the above devices relates to a combination of both of these features and provides webbed finger stalls with an inflatable air flotation collar around the wrist area. Nevertheless, such known devices do not provide sufficient buoyancy to aid in flotation and the cumbersomeness of these combination devices have prevented their widespread use. There have also been known large inflatable cushion-like devices that are placed over the hands of the user, but these are so large as to inhibit, rather than facilitate, swimming.

SUMMARY OF THE INVENTION

Accordingly, it is an object of the present invention to overcome the aforementioned disadvantages inherent in the prior art.

It is another object of the present invention to provide an inflatable swimming device which may be used by a swimmer to gain added stability in rough waters and to swim greater distances by providing increased surface area at noninflatable portions on the underside of a user's hands, and buoyant forces to keep a swimmer afloat when he or she becomes tired.

It is another object of the present invention to provide left and right hand versions of an inflatable swimming device, whereby each is fitted over a user's left and right hands and lower forearms respectively, to provide buoyant lifting forces and increased resistance to hand and arm movement while a swimmer performs aerobic exercises, physical therapy, or physical conditioning, thereby functioning as a means to develop muscles, stamina, and swimming skills.

A further object of the present invention is to provide a device of the character described which is formed of durable, inexpensive material, and may be efficiently and inexpensively manufactured.

In accordance with an aspect of the present invention, an inflatable flotation device comprises first and second adjustably inflatable chambers, superimposed one upon another, being in fluid communication and being joined by an airtight seam substantially circumscribing the periphery of the chambers and conforming to the outline of a user's hand and lower forearm. A hollow portion is arranged between adjacent sides of the inflatable chambers for receiving the user's hand and lower forearm, and the fit about the same may be adjusted by corresponding changes in chamber air pressure. Further modifications are also possible, such as an enlarged air chamber on the back of the device, opposite the valve area, to increase buoyancy and an extended skirt element around the periphery of the device to offer increased swimming power.

These and other features, objects, and advantages of the present invention will be apparent from the following detailed description of preferred embodiments of the invention when considered with the drawings.

DETAILED DESCRIPTION OF PREFERRED EMBODIMENTS

Figure 1:
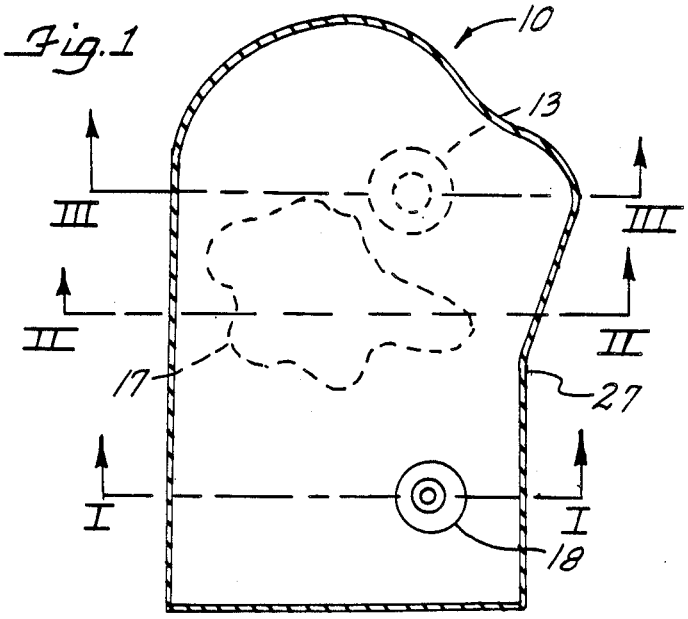
FIG. 1 is a top plan view of an inflatable swimming device in accordance with an embodiment of the present invention.
Figure 2:
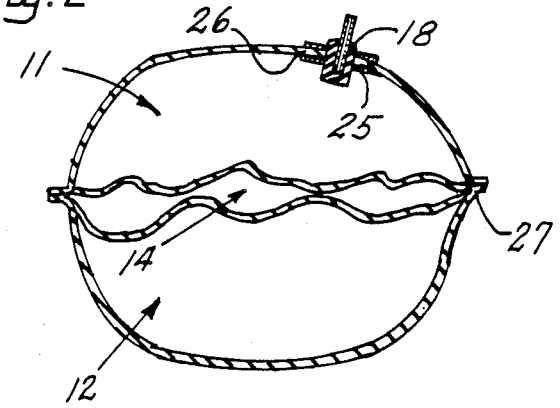
FIG. 2 is a cross-sectional view taken on section line I—I of FIG. 1.

FIG. 1 shows an inflatable flotation device 10 comprising a pair of collapsible, adjustably inflatable chambers 11 and 12, which are seen more clearly in FIG. 2. Chambers 11 and 12 are formed of flexible plastic material and are interconnected by a duct, shown typically at 13. A hollow portion 14, having an opening 15 lies between adjacent surfaces of chambers 11 and 12 to receive a user's hand and lower forearm. Duct 13 that provides fluid communication between chambers 11 and 12 is located in an area substantially between a user's thumb and index finger, thereby to provide a thumb stall 16 to receive a user's thumb when his hand is inserted in hollow portion 14. The interior and exterior surfaces of chamber 12 are joined throughout an area substantially adjacent a user's palm, forming a noninflatable portion shown typically at 17, to facilitate hand flexing motions when the chambers are in an inflated mode. Chambers 11 and 12 are hollow and a valve 18 is arranged, for example, through the exterior side of chamber 11, to permit the user to inflate or deflate the flotation device.

Figure 3:
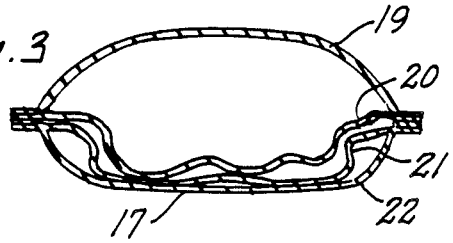
FIG. 3 is a cross-sectional view taken on section line II—II of FIG. 1.

Chambers 11 and 12 may be advantageously formed from four thin panels, shown in FIG. 3 as members 19, 20, 21 and 22, of substantially fluid impervious material, such as polyethylene, vinyl, or the like. Panels 19, 20, 21 and 22 are identical in shape and size and their outline, although not limited by such a configuration, substantially conforms to that of a user's hand and lower forearm. These panels may be manufactured by layering a suitable material and cutting the periphery with a single die, thereby providing one panel type which may be used for either left hand or right hand versions of the swimming device, and may be modified as required. An advantage of the present embodiment is that manufacturing costs related to tooling and assembly are relatively low because of the similarities in the mating parts and their ease of assembly into the completed flotation device, as described in further detail below.

Chambers 11 and 12 are comprised of panels 19 and 20 and panels 21 and 22, respectively, as shown in FIG. 3. Subsequent to being peripherally cut, panels 20 and 21, which form the adjacent surfaces of chambers 11 and 12 respectively, may be modified to include duct 13 for fluid communication. An aperture, shown typically at 23, is cut in dimensionally exact locations on each of panels 20 and 21. Of course, a single die may be developed to simultaneously cut both the periphery and aperture 23, of panels 20 and 21. Panels 20 and 21 are subsequently placed, one on top of another, so that their respective edges are aligned. The panels are joined by the formation of a continuous airtight seam, shown typically at 24, defined by the periphery of aperture 23, to define duct 13. Seam 24 may be formed by electronic welding or by any other suitable method providing a durable airtight seam. A feature of the present embodiment is that duct 13, comprised of aperture 23 and seam 24, permits fluid communication between chambers 11 and 12; hence, valve 18 is the only valve required to regulate air flow into and out of the entire flotation device. A user may thereby easily adjust the contour or fit of the device by manipulating the valve with his mouth, a particular advantage when seeking to adjust the air pressure while immersed in deep water.

Panel 19, which in the present embodiment forms the exterior surface of chamber 11, may be modified by forming an aperture, shown typically at 25 on FIG. 2, for receiving air valve 18. Air valve 18 is inserted into aperture 25 and sealed to a surface of panel 19 by a continuous airtight seam, shown typically at 26. Seam 26 may be formed by electronic welding, or by any other suitable method providing a durable airtight seam. As featured in the present embodiment and shown on FIG. 1, it is preferable to locate valve 18 on an exterior surface of chamber 11 adjacent a user's lower forearm, and not on a surface adjacent a user's hand when fitted in hollow portion 14. The surface areas adjacent a user's hand are subject to hand flexing motions which tend to reduce the clearance within chamber 11, thereby allowing contact between valve 18 and interiorly disposed surfaces of chamber 11, which would be felt by the user and possibly cause discomfort. Also, because valve 18 may protrude from the exterior chamber surface on which it is located, it may be safer to locate it away from the areas enveloping a user's hand, thereby decreasing the chance of contact between valve 18 and a user's face or eyes. Valve 18 may similarly be located on an exteriorly disposed surface of panel 22, of chamber 12, without any substantial change in performance or user comfort.

The noninflatable portion 17 is formed by joining the exterior surface of chamber 12, defined by panel 22 to the interior surface of that same chamber, defined by panel 21, through an area lying adjacent the palm of a user's hand when inserted in hollow portion 14, and substantially conforming to, although not limited by, the planar surface configuration of a user's palm. Noninflatable portion 17, may be formed by electronically welding panels 21 and 22 or by any other suitable method providing a durable airtight seam. The sealed surfaces of noninflatable portion 17 permit increased hand flexibility when a user's hand is inserted in hollow portion 14 and chambers 11 and 12 are in an inflated mode. Another advantage of the present embodiment is that the noninflatable portion 17 may facilitate a user's ability to swim with full strokes by reducing the magnitude of the buoyant forces exerted on the underside of the user's hand and lower forearm by inflated chamber 12. Of course, the noninflatable portion may also be formed to cover areas adjacent the fingers and/or lower forearm, permitting a user to swim relatively long distances with the advantage of increased surface area at his hand and forearm, with a reduction in the overall magnitude of buoyant forces exerted against the same. Furthermore, if a swimmer does become tired in deep water he may rest upon the buoyancy of the flotation device until his strength is regained.

Panel 19, which forms the exterior surface of chamber 11 in the present embodiment, is superimposed upon panels 20, 21, and 22, so that panel 19 is in contact with panel 20 and the edges of the four panels are substantially aligned, and panels 20 and 21 are interiorly disposed between panels 19 and 22 and are joined at duct 13, and panels 21 and 22 are joined at the noninflatable portion 17. Panel 19 is oriented so that its surface on the side of the filler opening of valve 18 is exteriorly disposed. Panels 19, 20, 21, and 22, are joined together at their edges to form an airtight peripheral seam, shown typically at 27, substantially circumscribing the four panels. Peripheral seam 27 may be formed by electronic welding or by any other suitable method providing a durable airtight seam. The peripheral portions of panels 19, 20, 21 and 22, disposed transverse to the longitudinal axis of the four interconnected panels, defines an interrupted portion in the peripheral seam 27. Along the interrupted portion, panels 19 and 20 are joined at their edges and panels 21 and 22 are similarly joined to form continuous airtight seams contiguous to peripheral seam 27, as shown typically at 28 and 29 respectively. Seams 28 and 29 may be formed by electronic welding, or by any other suitable method providing a durable airtight seam. The formation of seams 28 and 29, in conjunction with peripheral seam 27, transforms panels 19, 20, and 21, 22, respectively, into inflatable chambers 11 and 12. Seams 28 and 29 also define the opening 15, to the hollow portion 14, defined by the space between the adjacent sides of chambers 11 and 12. Another advantage of the flotation device according to the present embodiment is that when the chambers are in the deflated condition the device is flexible, yet substantially flat and planar, thereby allowing the user to easily remove his or her hand and lower forearm and fold or roll up the device for compact storage.

Figure 6:
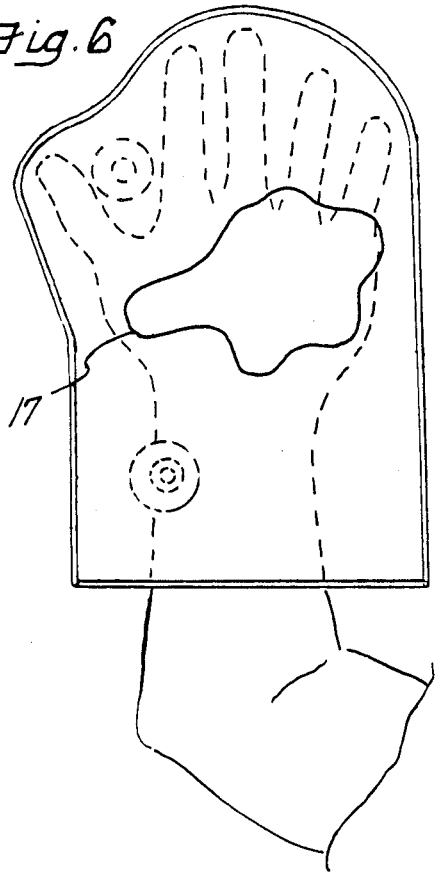
FIG. 6 is a bottom plan view of the inflatable swimming device of FIG. 1 shown fitted over a user's hand and lower forearm.

The thumb stall is arranged within the hollow portion, as shown typically at 16 on FIG. 2, to receive a user's thumb and thereby permit flotation device 10 to fit over a user's hand as would a mitten. Thumb stall 16 is defined by locating duct 13, comprised of aperture 23 and peripheral seam 24, substantially in the area between a user's thumb and index finger when the hand is fitted in the hollow portion 14, as shown typically on FIG. 6.

The swimming device 10 featured on FIGS. 1 through 6 is designed to receive a user's left hand and lower forearm. The manufacture of a right hand version would require a few simple changes to the procedures previously set forth for the transformation of panels 19, 20, 21, and 22, into inflatable chambers 11 and 12. Non-inflatable portion 17 would be defined by joining the exterior surface of chamber 11, defined by panel 19 on FIG. 3, to the interior surface of that same chamber, defined by panel 20 on FIG. 3, throughout an area lying adjacent a user's right hand palm when received in hollow portion 12 and his or her associated thumb is inserted in stall 16, and substantially conforming to the planar surface configuration of the user's palm. The outline of the right hand version's noninflatable portion would be a mirror image of the left hand version noninflatable portion 17 shown typically on FIG. 6.

Valve 18 is preferably located on the exteriorly disposed surface of chamber 12 of the right hand version, adjacent a user's lower forearm and not within the analagous surface of chamber 11 as previously set forth for the left hand version of this embodiment of the present invention.

One modification to the inventive device that may be advantageous is that non-inflatable ribs may be embossed on the area of the inflatable chamber that is adjacent the user's palm in a transverse orientation relative to the length of the device. These transverse ribs may also be embossed or otherwise formed on the back of the device, adjacent the back of the user's hand. These transverse, embossed ribs can provide easier bending or deformation of the device when the user cups his hands.

Figure 7:
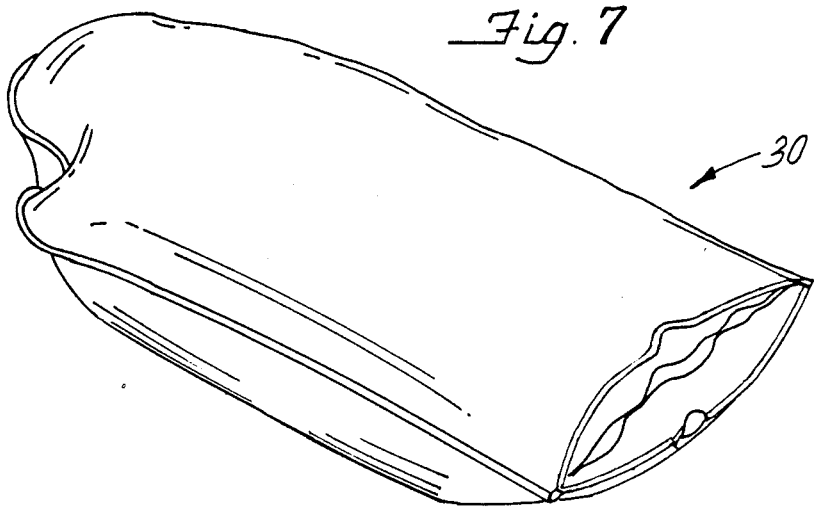
FIG. 7 is a rear perspective view of another embodiment of the device, showing an enlarged chamber to provide increased buoyancy.

FIG. 7 shows a further modification of the inventive device that provides increased buoyancy. On the back side of the device, opposite the valve, a bulge, shown generally at 30, is formed in the locale of the user's forearm. This bulge then provides an increased air chamber volume that produces an increased in buoyancy. This so-called bulge 30 can be formed by vacuum forming and having an appropriately shaped mold, and also by providing more material at that location when that portion of the device is die-cut, so that when the portions of the device are sealed together a deep tray is used to take up the space.

Figure 8:
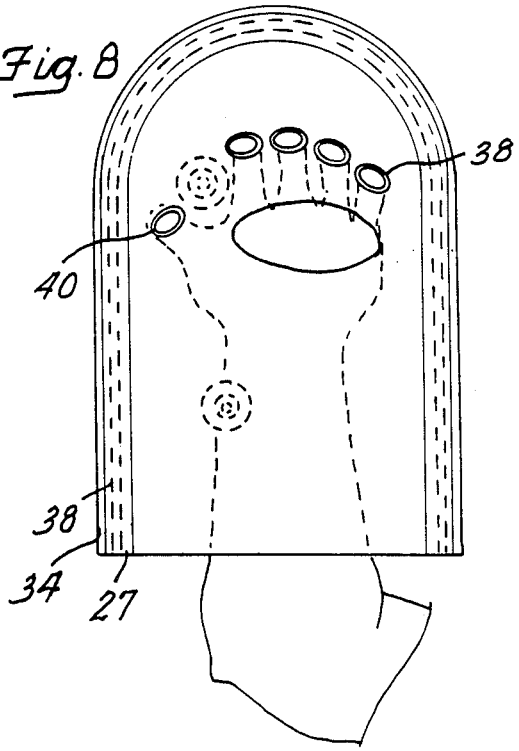
FIG. 8 is a bottom plan view of a further embodiment of the device having finger holes and a peripheral skirt element.

FIG. 8 shows still a further modification of the inventive device in which finger holes are through the bottom two panels to permit the user's fingers to protrude therethrough and a skirt element is added to increase the swimming capabilities of the user. In this embodiment a skirt 34 formed of the same plastics material as the device is arranded to depend from the peripheral seal 27 and extend substantially all around the device, except for the hand-access portion. This skirt 34 in combination with the palm portion of the device provides a scoop-like effect when the device is inflated so that during swimming the scoop greatly enchances the power available in each stroke. The skirt 34 is made to form the scoop when the device is inflated and to shape during use by a rigid but flexible, U-shaped, flat element 36 that is sealed inside skirt 34. This flat element 36 can be plastic or metal and is shown in phantom in FIG. 8. In place of flat element 36 a drawstring could be employed.

Also provided in the embodiment of FIG. 8 are finger holes, sown typically at 38, and a thumb hole 40 through which the user's fingers and thumb (not shown) could respectively protrude. This permits the user to grasp objects while wearing the device and could be particularly useful in a lifesaving operation for grasping a rope or life line. These finger and thumb holes are formed only through the bottom two panels of the device and the top surface remains as in the above-described embodiments.

Figure 9:
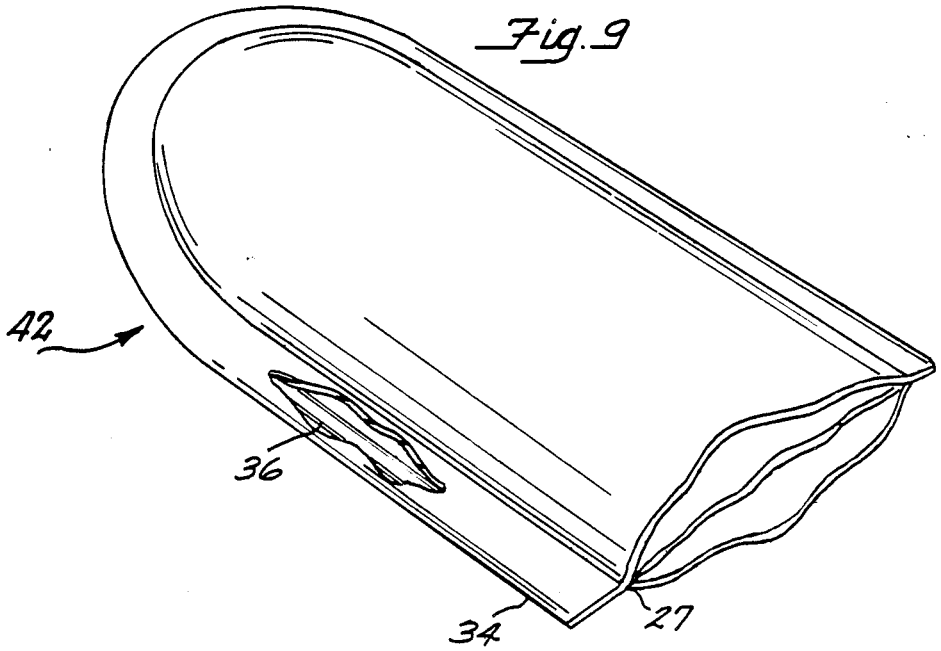
FIG. 9 is a rear perspective view of the embodiment of FIG. 8, in an inflated condition and showing the peripheral skirt used to provide increased swimming power.

FIG. 9 shows that top surface and also shows how skirt 34 is bowed downwardly and inwardly to form the scoop when the device is inflated. Because the entire device is a planar structure when uninflated, upon inflation skirt 34 being defined by rigid flat element 36 will deform somewhat. This deformation is represented by the wrinkles, shown generally at 42, appearing at the rounded peripheral areas. Also in this embodiment, the outline of the thumb has been deleted to provide smooth, rounded appearance.

Figure 4:
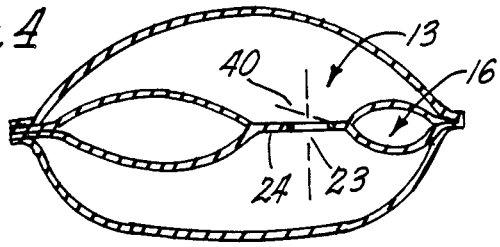
FIG. 4 is a cross-sectional view taken on section line III—III of FIG. 1.
Figure 5:
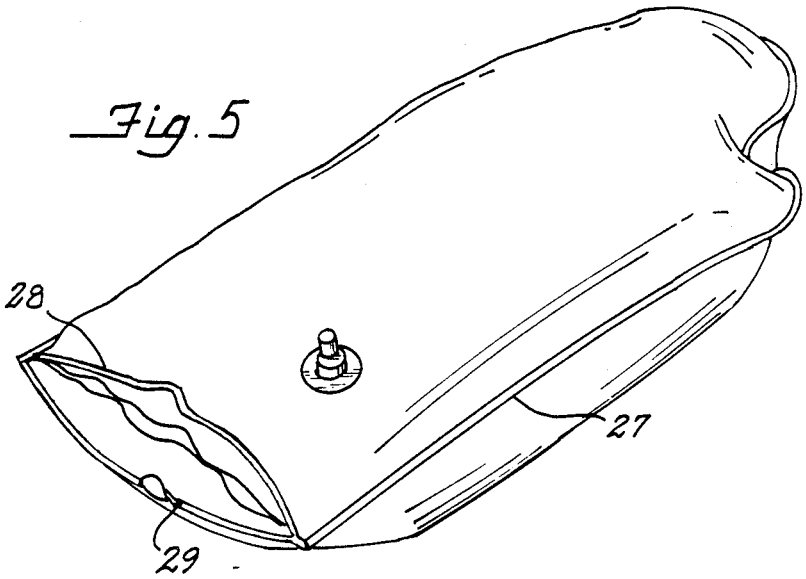
FIG. 5 is a rear perspective view of the inflatable swimming device of FIG. 1.

A further modification is shown by dashed line 40 in FIG. 4 that represents a metering flap-over value port 23. Flap 44 acts to restrict the flow of air between chambers 11 and 12 and adds a more rigid feeling to the inflated device. The flap 44 can be arranged to operate on either side of aperture 23 or a different kind of air flow regulator could also be advantageously employed.

Although a specific embodiment of the invention has been described in detail herein, with reference to the accompanying drawings, it is to be understood that the invention is not limited to those embodiments, and that various changes and modifications can be affected therein by one skilled in the art without departing from the scope or spirit of the invention as defined in the appended claims.

What is claimed is:

1. A flotation device comprising:

first and second adjustably inflatable chambers superimposed upon one another and joined at selected respective peripheral regions to form an airtight seam substantially circumscribing said chambers;

an opening and a hollow portion arranged between adjacent sides of said joined first and second chambers for receiving a user's hand and lower forearm;

fluid communicating means connected to said first and second chambers and arranged within said hollow portion for permitting fluid communication between said first and second chambers;

a noninflatable portion formed in one of said chambers at an exterior surface thereof and being arranged at a location corresponding to a location of the palm of the user's hand when inserted into said hollow portion for permitting flexing of said one of said chambers upon a flexing of the user's hand when received in said hollow portion and said chambers are in an inflated state;

at least one valve means formed in at least one of said chambers for permitting air to enter and exit said at least one chamber.

2. A flotation device as in claim 1, in which each of said first and second inflatable chambers include two panels of flexible, substantially fluid impervious material.

3. A flotation device as in claim 2, wherein said panels are identically shaped and sized substantially to conform to, but not limited by, the outline of a user's hand and lower forearm, are aligned, one on top of the other, so that two panels are exteriorly disposed and two interiorly disposed, and are joined at respective peripheral regions to form an airtight peripheral seam substantially circumscribing said panels.

4. A flotation device as in claim 3, wherein said opening to said hollow portion is defined by an interruption in said peripheral seam transversely disposed to the longitudinal axis of said chambers, and said pairs of exteriorly disposed and adjacent interiorly disposed panels are respectively jointed at their edges to form two continuous airtight seams along said interrupted portion contiguous with said peripheral seam.

5. A flotation device as in claim 4, wherein said fluid communicating means includes an aperture through said interiorly disposed panels, and a continuous airtight seam joining said panels along the periphery of said aperture, thereby permitting fluid communication between said chambers.

6. A flotation device as in claim 5, wherein said fluid communicating means is arranged in said hollow portion substantially in the area between a user's thumb and index finger when the hand is fitted in said hollow portion, to define a stall for receiving the thumb of a user's hand.

7. A flotation device as in claim 4, wherein said noninflatable portion is formed by joining a portion of an interiorly disposed panel adjacent the palm of the user's hand when inserted into said hollow portion to said adjacent exteriorly disposed panel, thereby forming said noninflatable portion at an exterior surface of one of said chambers.

8. A flotation device as in claim 1, wherein said valve means is located on an exterior surface of at least one of said chambers.

9. A flotation device as in claim 3, wherein said peripheral seam is formed by joining said panels along their edges to form an airtight peripheral seam substantially circumscribing said panels.

10. A flotation device as in claim 4, wherein said continuous airtight seams along said interrupted portion are formed by joining said pairs of adjacent interiorly and exteriorly disposed panels at their edges along said interrupted portion.

11. A flotation device as in claim 5, wherein said continuous seam is formed by joining said interiorly disposed panels along the periphery of said hole.

12. A flotation device as in claim 7, wherein said airtight seam defining said noninflatable portion is formed by joining said panels throughout an area substantially conforming to the surface configuration of the palm of a user's hand.

13. A flotation device as in claim 1, wherein said fluid communicating means includes an aperture through adjacent sides of said chambers and a continuous airtight seam joining said chambers along the periphery of said aperture.

14. A flotation device as in claim 13, wherein said fluid communicating means is arranged in said hollow portion substantially in the area between a user's thumb and index finger when the hand is fitted in said hollow portion, to define a stall for receiving the thumb of a user's hand.

15. A flotation device as in claim 1, wherein another of said chambers not having said noninflatable portion arranged therein has a distended surface portion for increasing an interior volume of said another chamber.

16. A flotation device as in claim 15, wherein said distended surface portion as arranged adjacent said opening.

17. A flotation device as in claim 1, further comprising a skirt device affixed to said peripheral regions and extending thereaway for forming a scoop around said one chamber having said noninflatable portion therein.

* * * * *